US006197734B1

(12) United States Patent
Vlasblom

(10) Patent No.: US 6,197,734 B1
(45) Date of Patent: Mar. 6, 2001

(54) HIGH WAX CONTENT HEAVY OIL REMOVER

(75) Inventor: Jack T. Vlasblom, Dunedin, FL (US)

(73) Assignee: Dotolo Research Ltd., Pinellas Park, FL (US)

( * ) Notice: Subject to any disclaimer, the term of this patent is extended or adjusted under 35 U.S.C. 154(b) by 0 days.

(21) Appl. No.: 09/417,513

(22) Filed: Oct. 13, 1999

(51) Int. Cl.[7] ..... C11D 3/44; C11D 1/72; C11D 1/22

(52) U.S. Cl. ..... 510/188; 510/213; 510/215; 510/365; 510/371; 510/407; 510/413; 510/414; 510/432; 510/463; 510/506; 510/484

(58) Field of Search ..... 134/40, 22.14; 166/304, 311; 510/188, 213, 215, 365, 371, 407, 413, 414, 432, 463, 506, 484

(56) References Cited

U.S. PATENT DOCUMENTS

| | | | | |
|---|---|---|---|---|
| 4,005,020 | * | 1/1977 | McCormick | 252/8.55 |
| 4,380,268 | * | 4/1983 | Martin | 166/304 |
| 5,399,282 | * | 3/1995 | Hansen et al. | 252/162 |
| 5,484,488 | * | 1/1996 | Hart et al. | 134/22.13 |
| 5,494,611 | * | 2/1996 | Howe | 252/548 |
| 5,514,300 | * | 5/1996 | Vlasblom | 252/542 |
| 5,780,407 | * | 7/1998 | Van Slyke | 510/188 |

* cited by examiner

*Primary Examiner*—Yogendra Gupta
*Assistant Examiner*—Charles Boyer
(74) *Attorney, Agent, or Firm*—Donald R. Fraser

(57) ABSTRACT

A high wax content heavy oil remover comprises dipropylene glycol mono n-butyl ether, ethoxylated alkyl mercaptan, salt of an alkyl aromatic sulfonic acid, branched alcohol ethoxylate, d-limonene, and white oil.

15 Claims, No Drawings

HIGH WAX CONTENT HEAVY OIL REMOVER

FIELD OF THE INVENTION

This invention relates generally to a high wax content heavy oil remover formulation. More particularly, the invention is directed to a composition useful for removing high wax content heavy oil and oily sludges from process equipment such as storage tanks, transfer piping, and pumping facilities.

BACKGROUND OF THE INVENTION

Conventional heavy oil degreaser compositions contain so-called "alkaline builders." Moreover, many heavy oil remover compositions include halogens which are undesirable for steel process equipment degreasers, because the halogens may contribute to stress cracking of the metal. Many heavy oil degreasers only work at full strength, and are ineffective when diluted by residual liquids contained within the process equipment being cleaned. Some heavy oil degreasers are ineffective at ambient temperatures and must be heated along with the process equipment in order to remove the heavy oil sludge. Conventional heavy oil removers generally are incapable of absorbing and/or neutralizing the toxic gases and vapors which have accumulated within fouled process equipment. Finally, many of the heavy oil remover compositions of the prior art are toxic and not biodegradable.

Moreover, conventional heavy oil remover compositions are not useful for dissolving and removing heavy oils that have a high wax content. When conventional heavy oil remover formulations are used to clean process equipment containing high wax content heavy oil sludges, it is observed that such formulations are incapable of dissolving many of the waxes in the sludge. Also, those materials which are dissolved do not easily self-demulsify when mixed petroleum waxes are present. This is particularly inconvenient since demulsification is essential to the recovery of useful petroleum products from a sludge cleaning process. Finally, high wax content petroleum sludges typically invert, changing from a liquid phase at ambient temperatures to a solid at conventional sludge cleaning temperatures in the range of 80 degrees Celsius and higher. Since these higher cleaning temperatures are required in conventional cleaning processes in order to dissolve and emulsify the largest carbon chain length and highest melting point waxes, this phenomenon of congealing at higher temperatures tends to diminish the ability of conventional heavy oil remover formulations to extract and recover the oils and waxes from high wax content heavy oil sludges.

Waxes are defined as substances that are plastic solids at ambient temperatures and, on being subjected to moderately elevated temperatures, become low viscosity liquids. One type of wax "Paraffin Wax" is a petroleum wax which occurs naturally in many types of crude oil around the world. Chemically, paraffins, and by extension paraffin waxes occurring naturally in petroleum, are usually mixtures of straight carbon chain alkanes. The physical properties of the paraffin waxes, including melting point, congealing point, and plastic flow properties, vary with the "carbon chain length" of the wax or waxes present in the petroleum. When combined with the presence of other types of petroleum hydrocarbons found in natural petroleum sources, the physical properties exhibited by wax impurities in natural petroleum can produce difficulties with storage tanks and other process equipment, leading to a buildup of difficult to remove sludges with a mixed wax and petroleum impurities content. These waxes eventually cause a reduction in tank storage and equipment processing capacity as they build up, and also present a difficult cleanup problem as they are by their chemistry not soluble in most solvents.

U.S. Pat. No. 5,085,710 to Goss discloses a composition for removing oil sludges utilizing an alkylphenol adduct and a castor oil etholylate. U.S. Pat. No. 5,389,156 to Mehta et al discloses a heavy oil degreaser including a terpene and a second nonionic co-surfactant from the family of ethylene oxide/propylene oxide polyol adducts. These disclosed formulations are not effective for dissolving high wax content heavy oils, and additionally suffer from a number of the undesirable characteristics listed above.

It would be desirable to prepare a high wax content heavy oil remover composition that is effective for dissolving and emulsifying high wax content heavy oil sludges, and which is additionally free from alkaline builders and halogens, capable of absorbing toxic gases and vapors such as hydrogen sulfide and benzene, nontoxic, and biodegradable.

SUMMARY OF THE INVENTION

Accordant with the present invention, there surprisingly has been discovered a high wax content heavy oil remover, comprising: from about 1 to about 80 weight percent dipropylene glycol mono n-butyl ether; from about 0.5 to about 50 weight percent ethoxylated alkyl mercaptan; from about 0.5 to about 90 weight percent salt of an aromatic sulfonic acid; from about 0.5 to about 50 weight percent branched alcohol ethoxylate; from about 1 to about 90 weight percent d-limonene; and from about 1 to about 90 weight percent white oil.

The high wax content heavy oil remover according to the present invention is particularly useful for dissolving and emulsifying high wax content heavy oil sludges from fouled process equipment and storage tanks.

DETAILED DESCRIPTION OF THE PREFERRED EMBODIMENT

The high wax content heavy oil remover formulation according to the present invention comprises a dipropylene glycol mono n-butyl ether, ethoxylated alkyl mercaptan, salt of an alkyl aromatic sulfonic acid, branched alcohol ethoxylate, d-limonene, and white oil.

The design of a high quality high wax content heavy oil remover requires attention to the chemical characteristics related to the performance enhancements required to achieve removal of high wax content heavy oils. Specifically, the most important chemical characteristics are solvency and detergency (or ability to emulsify). These factors affect the high wax content heavy oil remover's ability to clean and degrease metal surfaces, its impact on corrosion of the metal surfaces, its ability to be safely handled, and its environmental acceptability.

The high wax content heavy oil remover according to the present invention exhibits the desired characteristics of solvency and detergency. Moreover, halogens are absent from the formulation, thus reducing the potential for stress cracking of the metal process equipment. The inventive formulation is effective over a range of process temperatures, even when substantially diluted with water or residual process fluids. Finally, the inventive composition can absorb toxic vapors such as hydrogen sulfide and benzene, yet is itself non-toxic and biodegradable.

The inventive formulation's ability to dissolve and emulsify waxes contained in the heavy oil sludges is best understood by examining the mechanism by which the petroleum waxes are carried by the crude oil and subsequently congeal over time to become insoluble and settle in the crude oil sludge in the first place. The waxes at first are dissolved in the crude oil often under the tremendous pressures existing in natural petroleum formulations, possibly sometimes above the "saturation point," i.e., the point at which the liquid crude oil can under standard atmospheric pressure and ambient temperatures dissolve no more waxes without those waxes precipitating as sludges from the crude oil. Under conditions existing in the oil bearing formations in the earth, however, it is possible to "supersaturate" crude oil with petroleum (paraffinic) wax to the point above the saturation point. The wax then needs only a nucleus or seed wax crystal to rapidly solidify in a manner not unlike inorganic crystal growth in salts, which eventually causes the excess paraffin waxes to precipitate as sludge. The sludge then becomes a concentrated source of paraffin waxes.

The key to returning the paraffin wax in the heavy oil sludge to the dissolved liquid state in petroleum therefore is to provide a solvent into which the paraffin wax can dissolve. This is achieved by adding the inventive high wax content heavy oil remover, including white oils derived from paraffins and/or isoparaffins, to the high wax content petroleum sludges, said white oils having shorter carbon chain lengths than the paraffin waxes contained in the oily sludge. These white oils collectively are sometimes referred to as "technical white oils" within the petroleum industry.

Dipropylene glycol mono n-butyl ether according to the present invention is a moderately polar solvent, having excellent solvency for petroleum compounds, including waxes, and for other polar compounds present in trace amounts in petroleum sludges. This solvent component is non-toxic, environmentally acceptable, and exhibits a high flash point and low flammability making it safer to use than many other solvents. The dipropylene glycol mono n-butyl ether may be present in the inventive formulation at a concentration from about 1 to about 80 weight percent. Preferably, the concentration ranges from about 5 to about 20 weight percent. Most preferably, the concentration of dipropylene glycol mono n-butyl ether is about 12 weight percent.

An ethoxylated alkyl mercaptan is included in the inventive formulation as a surfactant and emulsifier. This ingredient utilizes sulfur chemistry to form an emulsifier having a particularly high affinity for penetrating high wax content heavy oil sludges in the presence of residual water and fluids contained in the process equipment being cleaned. Furthermore, the sulfhydryl functional groups can chemically bind hydrogen sulfide by reacting therewith to produce complex disulfide functional groups bound to the organic hydrophobe, thereby fixing the free hydrogen sulfide present in the high wax content heavy oil sludge and the vapor space of the process equipment being cleaned. The presence of the ethoxylate/ethereal functional groups, which are unaffected by the terminal mercaptan functional group reactions with hydrogen sulfide, assure that some hydrophilicity remains after these reactions occur, and thereby allow the surfactant properties of the ingredient to remain manifest. A preferred ethoxylated alkyl mercaptan may be obtained form the Burlington Chemical Company of Burlington, N.C. under the trade designation "BURCO TME." The ethoxylated alkyl mercaptan may be present in the inventive formulation at a concentration from about 0.1 to about 75 weight percent. Preferably, the concentration ranges from about 2 to about 10 weight percent. Most preferably, the concentration of ethoxylated alkyl mercaptan is about 4 weight percent.

An amine, alkali metal, or ammonium salt of an alkyl aromatic sulfonic acid is included in the inventive formulation as an anionic emulsifier. The alkylaromatic hydrophobe solubilizes well in high wax content petroleum sludges, and the degree of its solubility is modified by the presence of cosurfactants described hereinafter. The alkylaromatic sulfonate bond with the alkyl radical is weaker than a bond between an alkylaromatic sulfonate radical and an alkali metal atom such as sodium. This is important in controlling the degree to which the final product is able to emulsify the high wax content petroleum sludge, because a weak emulsion that is easily broken by the presence of minerals in the residual water and fluids in the process equipment being cleaned, is desirable in order to rapidly recover the oil which is ultimately separated. Moreover, the use of an alkylamine salt in a preferred embodiment eliminates the need for an ammonium salt as used in many conventional degreasers. Additionally, this preferred surfactant emulsifier produces little foam, compared to conventional anionic surfactants. Conveniently, this preferred ingredient, due to its weakly bound amine functional group, acts as an aggressive absorber and partial neutralizer for acidic gases such as hydrogen sulfide. Finally, the alkylamine salt according to the preferred embodiment of the present invention is a strong emulsifier for the solvent phase of the heavy oil remover, and contributes to the increased shelf life of the microemulsion formed between the cyclic hydrocarbon solvent/dipropylene glycol mono n-butyl ether cosolvent mixture and water. The required ingredient may be an amine, alkali metal, or ammonium salt of an alkyl benzene or alkyl naphthalene sulfonic acid. Suitable examples include, but are not limited to, an isopropylamine salt of linear dodecylbenzene sulfonic acid, an isopropylamine salt of branched dodecylbenzene sulfonic acid, a diethanolamine salt of linear or branched dodecylbenzene sulfonic acid, and the like, as well as mixtures thereof. A preferred salt of an alkyl aromatic sulfonic acid is isopropylamine linear dodecylbenzene sulfonate, available from the Pilot Chemical Company of Los Angeles, Calif. under the trade identifier "CALIMULSE PRS." The alkyl aromatic salt may be present in the inventive formulation at a concentration from about 0.5 to about 90 weight percent. Preferably, the concentration ranges from about 10 to 30 weight percent. Most preferably, the alkyl aromatic sulfonic acid is present at a concentration of about 20 weight percent.

A branched alcohol ethoxylate is included according to the present invention as a nonionic surfactant and a self demulsifying detergent for reducing the emulsifying effects of the salt of an alkyl aromatic sulfonic acid. Without wishing to be bound by any particular theory describing the mechanism by which this ingredient contributes to the efficacy of the inventive high wax content heavy oil remover, it is believed that the branched alcohol hydrophobe interacts with the hydrophobic moiety of the alkyl aromatic salt primary emulsifier. This weakens the emulsification potential of the alkyl aromatic salt to a degree that the trace minerals present in the residual water or fluids in the process equipment being cleaned electrolytically assist the demulsification of the high wax content heavy oil from the extractant cleaning mixture, thereby promoting the recovery of the waxes and heavy oil. A preferred branched alcohol ethoxylate according to the present invention is available from Tomah Products, Inc. of Milton, Wisconsin under the trade designation "TEKSTIM 8741." The branched alcohol ethoxylate may be present in the inventive formulation at a concentration from about 0.5 to about 50 weight percent. Preferably, the concentration ranges from about 2 to about 10 weight percent. Most preferably, the concentration of branched alcohol ethoxylate is about 5 weight percent.

D-limonene is present in the inventive formulation as a solvent for the heavy oils. D-limonene is a terpene which occurs naturally in all plants. It is a monocyclic unsaturated terpene which is generally a by-product of the citrus industry, derived from the distilled rind oils of oranges, grapefruits, lemons, and the like. A discussion concerning d-limonene and its derivation from numerous sources is set forth in Kesterson, J. W., "Florida Citrus Oil," Institute of Food and Agriculture Science, University of Florida, December, 1971.

D-limonene exhibits low human toxicity and is considered environmentally benign. It functions in the present inventive formulation as a portion of the solvent phase, for solubilizing the petroleum sludges, and as an absorbent for benzene contained in the oil sludges and the vapor spaces of the process equipment. Furthermore, d-limonene exhibits excellent solubility for the higher bitumen and asphaltene compounds commonly found in petroleum sludges. D-limonene is commercially available from Florida Chemical Company and from SMC Glidco Organics. D-limonene may be present in the inventive formulation at a concentration from about 1 to about 90 weight percent. Preferably, the concentration is from about 5 to about 20 weight percent. Most preferably, the concentration of cyclic hydrocarbon solvent is about 10 weight percent.

The inventive formulation includes white oil to assist in solubilizing the waxes in the high wax content heavy oil sludges. White oils are well-known derivatives of paraffinic or isoparaffinic hydrocarbons having moderate viscosities, low volatilities, and high flash points. Straight chain paraffinic and branched chain isoparaffinic white oils are generally referred to as mineral oils and technical white oils. A suitable white oil is available from Lyondell Lubricants of Mulga, Ala. under the product designation "DUOPRIME 90 WHITE MINERAL OIL." The white oil is present in the inventive formulation at a concentration from about 1 to about 90 weight percent. Preferably, the concentration ranges from about 25 to about 75 weight percent. Most preferably, the concentration of white oil is about 49 weight percent.

In operation, the process equipment that is to be degreased utilizing the inventive formulation is drained of process fluids after the equipment has been shut down. The high wax content heavy oil sludge within the process equipment is heated to a temperature ranging from about 50 degrees to about 100 degrees Celsius. Preferably, the temperature is about 90 degrees Celsius. Thereafter, a quantity of the inventive high wax content heavy oil remover formulation is added directly to the process equipment, to contact the sludges to be removed. The quantity of high wax content heavy oil remover added to the process equipment may vary from about 5% to about 20% of the estimated weight of the oily sludges. Preferably, the quantity of the inventive formulation added to the process equipment equals about 10 weight percent of the high wax content oily sludges to be removed. Conveniently, the inventive formulation and dissolving high wax content oily sludges may be recirculated through the process equipment and continuously heated by conventional means, to accelerate the dissolution of the waxes and heavy oils.

After the waxes and heavy oils have been solubilized by the inventive formulation, hot water containing electrolytes, e.g., sea water, is added to the mixture at a rate of from about 10 to about 20 times the weight of the inventive formulation. Preferably, the amount of water is about 15 times the weight of the inventive formulation. The temperature of the water may vary from about 50 degrees to about 95 degrees Celsius. Preferably, the temperature of the water is about 60 degrees Celsius. The electrolytes enhance and speed the completeness of the oil separation from the aqueous detergent and bottoms layers. Alternatively, water without electrolytes may be used, but the speed and completeness of oil separation will be diminished.

Finally, the mixture is allowed to stand, usually for a period of several hours. Thereafter, a layer of oil containing waxes may be recovered from the top of the mixture, followed by a straw-colored layer of aqueous detergent, and finally a layer of bottoms containing solids, sand, clay, and the like.

EXAMPLE

The following ingredients are mixed together in the approximate weight percentages indicated, to prepare a high wax content heavy oil remover, according to the present invention. It is added to sludge-containing process equipment at a concentration of about 10% of the estimated weight of the sludge. Thereafter, the formulation and dissolving sludge are recirculated through the process equipment at a temperature of about 90 degrees C. After the high wax content heavy oil sludge is solubilized, sea water, at approximately 15 times the weight of the degreaser, at a temperature of about 60 degrees C, is thoroughly mixed with the solubilized sludge. The entire mixture is allowed to stand for about 72 hours. Thereafter, layers of high wax content oil, aqueous detergent, and water bottoms are extracted from the process equipment.

TABLE I

HIGH WAX CONTENT HEAVY OIL REMOVER

| Ingredient | Weight Percent |
|---|---|
| di-Propylene glycol mono n-butyl ether | 12 |
| ethoxylated alkyl mercaptan (1) | 4 |
| salt of an alkyl aromatic sulfonic acid (2) | 20 |
| branched alcohol ethoxylate (3) | 5 |
| d-limonene | 10 |
| white oil | 49 |

(1) BURCO TME, Burlington Chemical Company
(2) CALIMULSE PRS, Pilot Chemical Company
(3) TEKSTIM 8741, Tomah Products, Inc.

The Example may be repeated with similar success by substituting the generically or specifically described ingredients and/or concentrations recited herein for those used in the preceding Example.

From the foregoing description, one ordinarily skilled in the art can easily ascertain the essential characteristics of this invention and, without departing from its spirit or scope, can make various changes and/or modifications to adapt the invention to various uses and conditions.

What is claimed is:

1. A high wax content heavy oil remover, comprising:

from about 1 to about 80 weight percent dipropylene glycol mono n-butyl ether;

from about 0.5 to about 50 weight percent ethoxylated alkyl mercaptan;

from about 0.5 to about 90 weight percent salt of an aromatic sulfonic acid;

from about 0.5 to about 50 weight percent branched alcohol ethoxylate;

from about 1 to about 90 weight percent d-limonene; and from about 1 to about 90 weight percent white oil.

2. The high wax content heavy oil remover according to claim 1, wherein the concentration of dipropylene glycol mono n-butyl ether ranges from about 5 to about 20 weight percent.

3. The high wax content heavy oil remover according to claim 1, wherein the concentration of ethoxylated alkyl mercaptan ranges from about 2 to about 10 weight percent.

4. The high wax content heavy oil remover according to claim 1, wherein the concentration of salt of an aromatic sulfonic acid ranges from about 10 to about 30 weight percent.

5. The high wax content heavy oil remover according to claim 1, wherein the concentration of branched alcohol ethoxylate ranges from about 2 to about 10 weight percent.

6. The high wax content heavy oil remover according to claim 1, wherein the concentration of d-limonene ranges from about 5 to about 20 weight percent.

7. The high wax content heavy oil remover according to claim 1, wherein the concentration of white oil ranges from about 25 to about 75 weight percent.

8. A high wax content heavy oil remover, comprising:

from about 5 to about 20 weight percent dipropylene glycol mono n-butyl ether;

from about 2 to about 10 weight percent ethoxylated alkyl mercaptan;

from about 10 to about 30 weight percent salt of an aromatic sulfonic acid;

from about 2 to about 10 weight percent branched alcohol ethoxylate;

from about 5 to about 20 weight percent d-limonene; and from about 25 to about 75 weight percent white oil.

9. The high wax content heavy oil remover according to claim 8, wherein the concentration of dipropylene glycol mono n-butyl ether is about 12 weight percent.

10. The high wax content heavy oil remover according to claim 8, wherein the concentration of ethoxylated alkyl mercaptan is about 4 weight percent.

11. The high wax content heavy oil remover according to claim 8, wherein the concentration of salt of an aromatic sulfonic acid is about 20 weight percent.

12. The high wax content heavy oil remover according to claim 8, wherein the concentration of branched alcohol ethoxylate is about 5 weight percent.

13. The high wax content heavy oil remover according to claim 8, wherein the concentration of d-limonene is about 10 weight percent.

14. The high wax content heavy oil remover according to claim 8, wherein the concentration of white oil is about 49 weight percent.

15. A high wax content heavy oil remover, comprising:

about 12 weight percent dipropylene glycol mono n-butyl ether;

about 4 weight percent ethoxylated alkyl mercaptan;

about 20 weight percent salt of an alkyl aromatic sulfonic acid;

about 5 weight percent branched alcohol ethoxylate;

about 10 weight percent d-limonene; and about 49 weight percent white oil.

* * * * *